US008640374B1

(12) United States Patent
Reichelt

(10) Patent No.: US 8,640,374 B1
(45) Date of Patent: Feb. 4, 2014

(54) FIREARM CARTRIDGE MAGAZINE SYSTEM

(71) Applicant: Anthony Reichelt, Snohomish, WA (US)

(72) Inventor: Anthony Reichelt, Snohomish, WA (US)

( * ) Notice: Subject to any disclaimer, the term of this patent is extended or adjusted under 35 U.S.C. 154(b) by 0 days.

(21) Appl. No.: 13/671,355

(22) Filed: Nov. 7, 2012

(51) Int. Cl.
*F41C 27/00* (2006.01)

(52) U.S. Cl.
USPC ..... 42/90; 42/106

(58) Field of Classification Search
USPC ..... 42/90, 106; 89/34, 1.1, 1.4
See application file for complete search history.

(56) References Cited

U.S. PATENT DOCUMENTS

| | | | | | |
|---|---|---|---|---|---|
| 2,147,208 | A * | 2/1939 | Nolan | 42/49.01 |
| 3,623,256 | A * | 11/1971 | Shiplee, III | 42/50 |
| 4,100,694 | A * | 7/1978 | Musgrave | 42/90 |
| 4,115,943 | A * | 9/1978 | Musgrave | 42/90 |
| 4,484,404 | A | 11/1984 | Johnson | |
| 4,628,627 | A | 12/1986 | Johnson | |
| 5,279,059 | A * | 1/1994 | Howard | 42/90 |
| 6,668,479 | B1 * | 12/2003 | Obong | 42/90 |
| 6,698,129 | B1 | 3/2004 | Hanks | |
| 6,796,074 | B1 * | 9/2004 | Obong | 42/90 |
| D502,524 | S * | 3/2005 | Fisher et al. | D22/108 |
| 7,073,285 | B2 * | 7/2006 | Obong | 42/90 |
| 7,194,837 | B2 * | 3/2007 | Obong | 42/90 |
| 7,497,043 | B2 | 3/2009 | Clifton, Jr. et al. | |
| 7,805,875 | B1 * | 10/2010 | Obong | 42/90 |
| 7,975,420 | B2 * | 7/2011 | Pestana | 42/90 |
| D689,581 | S * | 9/2013 | Fitzpatrick et al. | D22/108 |
| 2005/0115136 | A1 * | 6/2005 | Obong | 42/87 |
| 2007/0022650 | A1 * | 2/2007 | Obong | 42/90 |

* cited by examiner

*Primary Examiner* — Jonathan C Weber
(74) *Attorney, Agent, or Firm* — Dwayne E. Rogge; Schacht Law Office, Inc.

(57) ABSTRACT

Several examples of a cartridge magazine system are shown each arranged to hold a plurality of cartridge magazines adjacent to a magazine well of a weapon. The system including several interoperating components, for example: a rigid cylindrical shaft having a center axis aligned with an insert axis of the magazine well, a cartridge magazine holder assembly, and a stop cap at a lower end of the shaft to maintain position of the cartridge magazine holder assembly upon the shaft. One example of the magazine holder assembly including: a collar in contact with the shaft so as to freely reposition along the shaft wherein the collar is rotatable about the shaft. At least one fork extends radially from the collar. Wherein each fork includes a surface for retention of a cartridge magazine in position to be inserted into and removed from the magazine well without removing the magazine from the fork.

14 Claims, 11 Drawing Sheets

FIREARM CARTRIDGE MAGAZINE SYSTEM

BACKGROUND OF THE DISCLOSURE

Field of the Disclosure

This disclosure relates to the field of weapon accessories, specifically, a magazine holder which can be mounted to a weapon and is configured to hold a plurality of cartridge magazines to be selectively inserted and removed from a magazine well while the cartridge magazines are attached to the magazine holder.

SUMMARY OF THE DISCLOSURE

Disclosed herein are several examples of a cartridge magazine system configured and arranged to hold a plurality of cartridge magazines adjacent to a magazine well of a weapon. The term weapon meant to include firearms such as rifles and handguns, as well as simulated weapons such as training tools. The cartridge magazine system comprising several interoperating components, for example: a rigid cylindrical shaft having a center axis aligned with an insert axis of the magazine well, a cartridge magazine holder assembly, and a stop cap at a lower end of the shaft to maintain position of the cartridge magazine holder assembly upon the shaft. The insert axis aligned with the linear direction of travel the cartridge magazine follows when being inserted into, or being removed from the magazine well of the weapon. One example of the cartridge magazine holder assembly comprising: a collar in contact with the shaft so as to freely reposition along the shaft a distance greater than an insert distance of the magazine well; wherein the collar is rotatable about the shaft; at least one fork extending radially from the collar. Wherein each fork comprises an engagement surface for retention of a cartridge magazine in position to be inserted into the magazine well, and removed therefrom without removing the cartridge magazine from the fork.

The cartridge magazine system as described above may be arranged wherein the engagement surface on the fork comprises a detent. In this example, the cartridge magazine comprises an indent on a transverse side thereof, and; the detent of the fork engages the detent of the magazine cartridge to retain the magazine on the fork.

The cartridge magazine system may further comprise a guide bar extending from the cartridge magazine holder assembly. The guide bar in at least one example having a rearward curved bottom end which engages and retains a forward bottom edge of the cartridge magazine to further hold the cartridge magazine in the fork.

The cartridge magazine system may be arranged wherein the bottom end of the guide bar comprises a visual marker. In at least one example, the visual marker is luminescent.

To attach the cartridge magazine system to a weapon, a. a clamp fixedly attached to the rigid cylindrical shaft; and b. the clamp removably attached to a structure of the weapon.

c. The cartridge magazine system as recited in claim 6 wherein the structure to which the claim is attached is a Picatinny style rail.

d. The cartridge magazine system as recited in claim 1 further comprising a malleable collar mounted to the shaft.

DESCRIPTION OF THE PREFERRED EMBODIMENTS

Figure 1:
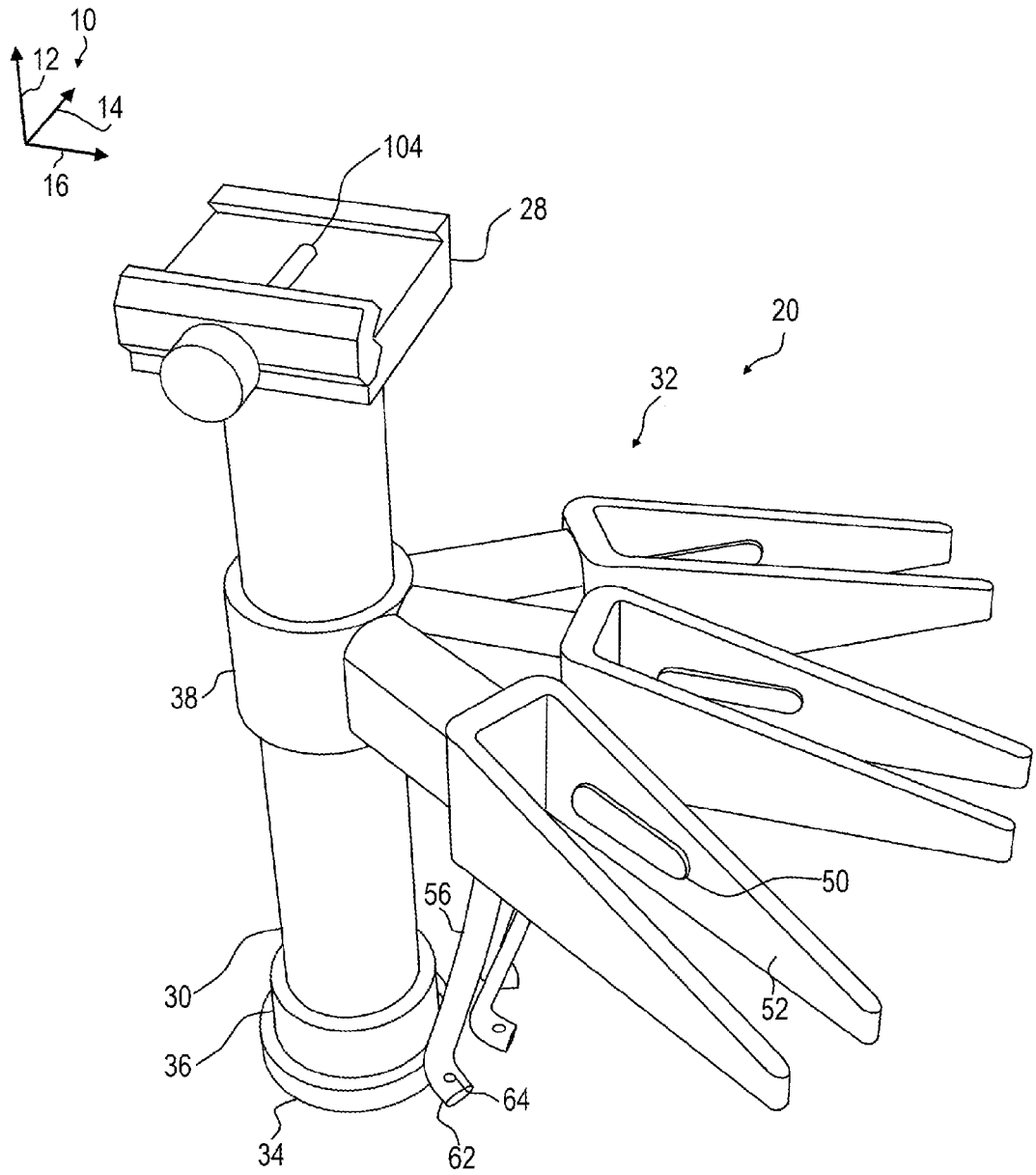
FIG. 1 is an isometric view of one example of the cartridge magazine system.

One example of the disclosed cartridge magazine system 20 is an under barrel mounted accessory designed to hold two or more modified cartridge magazines 22 for the purpose of rapid reloads of the weapon with less potential for operator error. Designed for the combat shooter in mind, the cartridge magazine system specifically addresses the potential situation where a shooter could be caught in a firefight without ammunition in their weapon 24 by an enemy, due to reloading; and significantly reduces this possibility.

Before continuing with a disclosure of the system, an axes system 10 is disclosed comprising a vertical axis 12, a longitudinal axis 16 orthogonal to the vertical axis 12 and parallel to the barrel of the weapon 24, and a transverse axis 14 orthogonal to both the vertical axis 12 and the longitudinal axis 16. Also, a labeling system will be used where particular components are labeled with a numeric prefix and a symbol suffix. For example, a first or generic arm labeled 44, with additional or specific arms labeled 44' and 44".

As mentioned, the cartridge magazine system 20 is mounted to the weapon 24, in one example on the underside of the barrel or hand guard 26. One example of a mounting system 28 is disclosed, but others could alternatively be used. The cartridge magazine system in one example uses a cylindrical shaft 30 extending downward, with respect to the weapon 24, to provide guided vertical movement of the magazine holder assembly 32. The term vertical used to correspond to the example of the drawings, but in more general terms used to indicate a direction aligned with the insert axis of the magazine well. In one example, at the bottom of the shaft 30 is a stop cap 34 that can be attached to the shaft. This stop cap aids in keeping the magazine holder assembly 32 on the shaft 30 and may take several different forms. Also disclosed is a malleable collar 36. In one example, the stop cap 34 holds the malleable collar 36 in place. The malleable collar 36 is used to cushion the weight of a loaded magazine holder assembly 32, and to reduce noise created by the operation of the cartridge magazine system 20.

Figure 7:
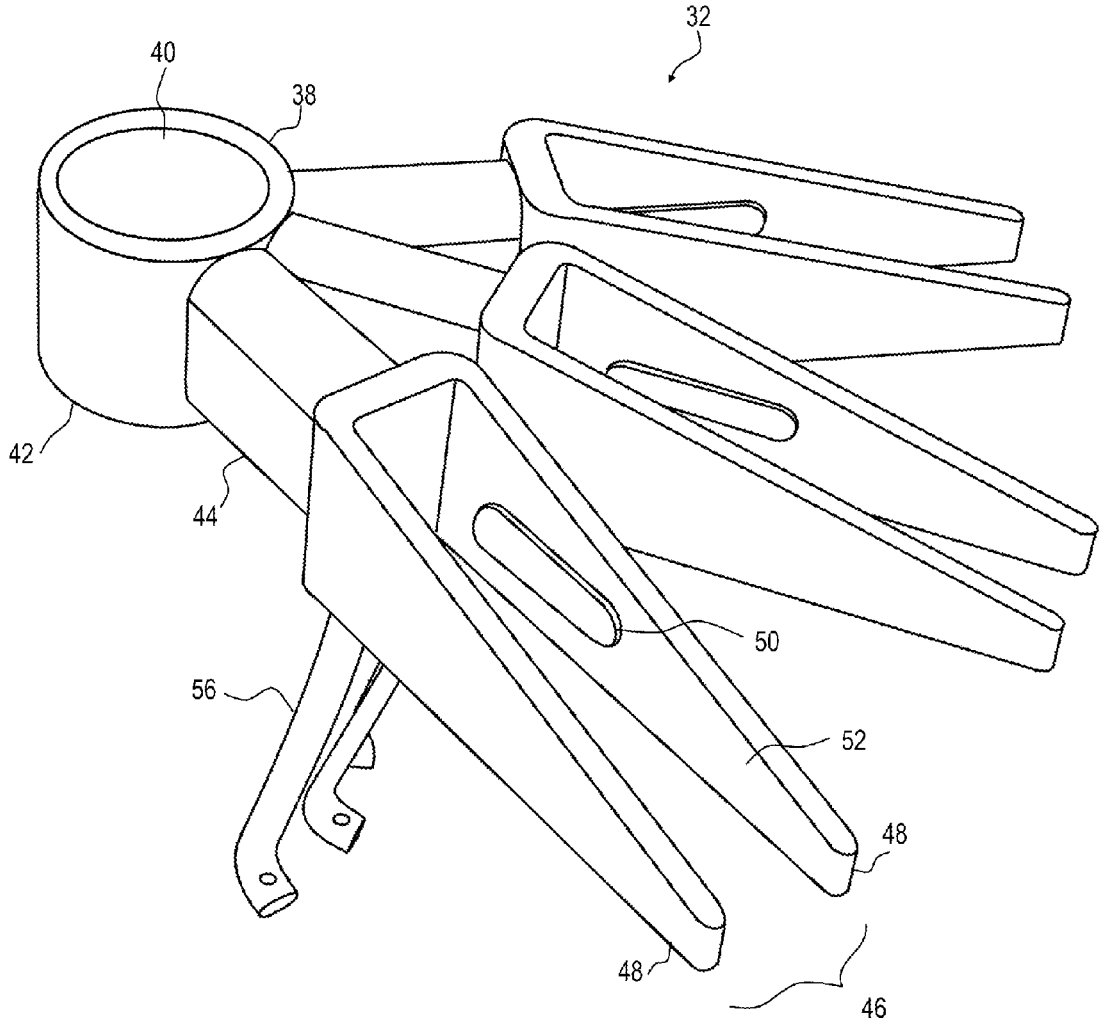
FIG. 7 is an isometric view of one example of a magazine holder component of the cartridge magazine system.

The magazine holder assembly 32 in one example slides freely vertically along the shaft 30 and can also rotate about the axis of the shaft 30 so as to allow positioning of multiple cartridge magazines. In one example, the magazine holder assembly 32 as best seen in FIG. 7 comprises a slide collar 38 with an inner surface 40 and an outer surface 42. In one form a plurality of arms 44 extend radially from the collar 38. Each arm in one example terminates with a fork 46 having a plurality of tines 48. Each fork 46 is designed to hold one cartridge magazine 22. Each magazine holds several cartridges or shells. Each fork comprises two tines engaging the sides of a modified magazine 22. In one example, each of the tines comprise a small detents 50 on the inside surface 52 of these tines 48 which engage/snap into indents 54 on the magazine 22 to hold the magazine 22 in position relative to the fork 46. In one example, extending down from the base of the arms 44 is a guide bar 56 which follows the front face 58 of the magazine to a rearward curved bottom edge 60. In one example the bottom end 62 of the guide bar follows the bottom edge contour of the magazine for a short distance. This bottom end 62 assists in holding the magazine 22 in position relative to the magazine holder assembly 32 and also may assist in loading the system 20 with new magazines 22 when the magazines 22 have been expended.

In one example, on the inside of bottom end 62 of the guide bar is a luminescent dot 64 or other marker which aids the shooter in seeing the guide bar in low light situations. In use, the guide bar aids the shooter in reloading the cartridge magazine system quickly and accurately.

In one example, the magazine 22 may be only modified to the extent of having an added set of indents 54 that conform to the size and shape of the detents 50 on the inside of the tines 48, to permit a stable engagement between the magazine 22 and the fork 46.

Benefits of the cartridge magazine system include:

1. In the hands of a practiced shooter the cartridge magazine system 20 can significantly reduce the time it takes to reload the weapon 24.
2. In the hands of a practiced shooter the cartridge magazine system 20 can reduce the risk of potentially fatal mistakes made by the shooter; specifically movements in the reloading process that require a high degree of muscle memory where even if a minor mistake is made, crucial time could be lost.
3. The cartridge magazine system can enable a practiced shooter to engage a target if necessary while the cartridge magazine system 20 itself is being reloaded.
4. The cartridge magazine system 20 offers more reliability than a high capacity drum magazine due to multiple magazines 22 being used (multiple springs) instead of just one.
5. With a drum magazine the shooter ultimately runs out of ammunition in the drum and the shooter is faced with having to do a standard reload of the weapon; with the cartridge magazine system 20, a shooter can replenish the round count in the cartridge magazine system while still having a magazine 22 in the weapon.
6. If multiple types of ammunition are being used by the shooter, the cartridge magazine system 20 enables the shooter to quickly change from one ammunition source (magazine 22) to another with a different style ammunition, such as hollow point, tracer, armor piercing, rubber tip, etc.
7. If a shooter depletes all ammunition sources (magazines 22) with the cartridge magazine system 20 of one example, the magazine holder assembly 32 can be rotated to the side so that no fork is aligned with the magazine, thus permitting the shooter to use traditional reloading techniques.

Operation of the Cartridge Magazine System:

Reloading the weapon 24—When the shooter determines that a reload must be made, the shooter depresses the magazine release button 66 standard to most all weapons using magazines. Release of the magazine release button disengages the magazine catch of the weapon from the indents 68 of the magazine which allows gravity and/or other/manual force to reposition the magazine holder assembly 32 downward along the shaft 30 with any magazines 22 that may be attached thereto. The magazine holder assembly 32 along with all attached magazines 22 will reposition downward a slide distance 70 to clear the bottom edge 72 of the magazine well 74 of the weapon 24. In one example, the slide distance 70 is measured from the bottom edge 76 of the collar 38 to the top edge 79 of the stop cap 34. If a malleable collar 36 is used, then the slide distance 70 is measured from the bottom edge 76 of the collar 38 to the top edge 80 of the malleable collar 36. An insert distance 82 is generally the distance from the bottom edge 72 of the magazine well 74 to the top edge 84 of a magazine. More specifically, the insert distance is the distance the magazine must travel to be inserted and seated in an operating position within the magazine well 74 to allow cartridges to be fired. The insert distance 82 may vary from weapon platform to weapon platform. For example, an AR-15 may have a much different insert distance than a 50 caliber rifle.

When the magazine 22 is released from the magazine well, the magazine 22 and holder assembly 32 must reposition with enough clearance so that the holder assembly 32 and the magazines 22 can be rotated about the shaft axis. The shooter may then manipulate the holder assembly 32 and magazines 22 to align a selected magazine with the magazine well. Once aligned, the shooter repositions (lifts) the selected magazine 22 along with the holder assembly 32 and other magazines 22 attached to the holder assembly 32. The selected magazine is inserted into the magazine well 74 until the weapon's magazine release 66 latches onto the indent 68 of the inserted magazine 22.

Reloading the Cartridge Magazine System:

When the shooter determines that a magazine 22 in the holder assembly 32 needs to be exchanged with another magazine 22 for whatever reason, the shooter will first remove the inserted magazine 22. In order to do this the shooter may relieve compression pressure on the magazine 22 exerted on the magazine 22 by the tines 48. To do this, the shooter may apply outward pressure onto the tip of one of the tines 48. Once compression pressure on the magazine 22 is relieved, the shooter can pull the magazine 22 free of the fork 46. In another example, the use may be able to provide sufficient rotational/linear force on the magazine 22 to remove it from the fork 46 without independently reposition the tines 48. With the new magazine 22 in hand the shooter may place the front bottom corner 60 of the magazine 22 into the bend 62 in the guide bar 56 and rotate/slide the magazine 22 up into the fork 46. This installation movement may continue so as to engage the indents 54 upon the detents 50. The reloading of one magazine 22 of the cartridge magazine system is complete when the new magazine 22 is securely placed between the forks.

Method of operation—In one example, the shooter will determine a primary and secondary magazine. In an example using a system with three or more arms/forks, the shooter may also determine one or more reserve magazines. Once the shooter has expended the ammunition in the primary magazine the shooter may immediately reload the weapon 24 with the secondary magazine. Once the shooter begins to use ammunition from the secondary magazine in a combat situation, the shooter should begin to look for a safe time and location to reload (remove and replace) the primary magazine fork. If a suitable location is found and time is available (i.e. sufficient cover and a lull in the firefight), the shooter should reload the primary magazine slot. Note: while reloading a fork in the magazine holder, the shooter may simultaneously engage a target while there is a loaded magazine properly inserted into the magazine well of the weapon. Upon completing reload of the primary magazine, the secondary magazine (loaded in the weapon and supplying ammunition to the weapon) can be quickly replaced by the primary magazine by a reverse of the same process disclosed above. This alternating primary and secondary magazines may be repeated until the shooter deems it not necessary or practical/possible. In an example with more than two forks, if in the event that a safe time or place cannot be found the shooter may reload the weapon with the reserve magazine if necessary and available. Upon loading the reserve magazine into the magazine well, the shooter will continue to look for a safe time/place to reload the empty slots in the magazine holder assembly. The shooter may also conduct a reload of a holder if a magazine becomes inoperative.

In another example, a magazine 22 not in place within the magazine well 74 may be reloaded with unfired cartridges while still in place in the magazine holder assembly 32.

Figure 2:
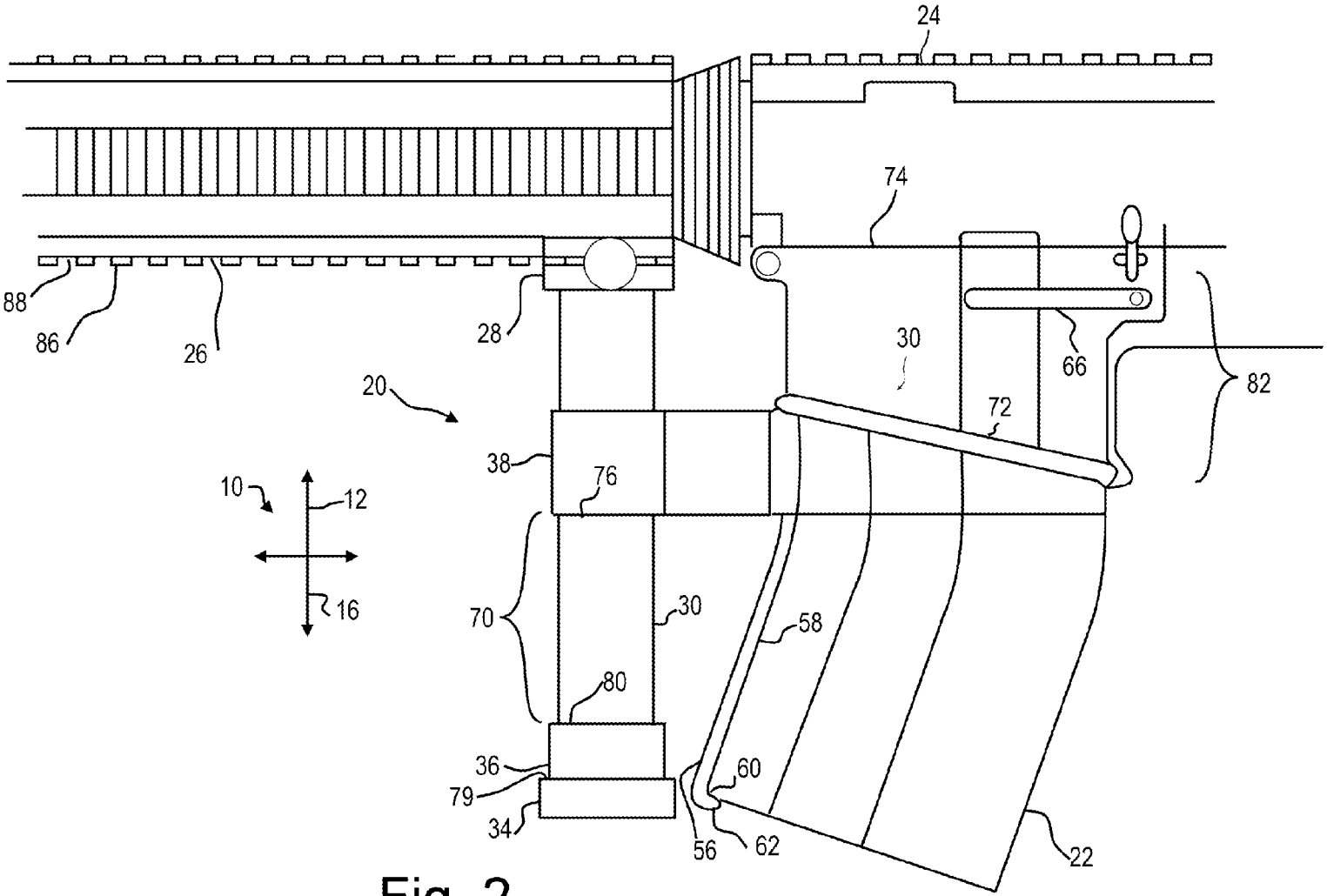
FIG. 2 is a side view of one example of the cartridge magazine system, mounted to a weapon.

In one example, the cartridge magazine system 20 mounts to a Picatinny rail 86 or other structure on the underside 88 of the weapon 24. In FIG. 2, the magazine system is shown attached to a Picatinny rail 86 of the hand guard 26 of the weapon 24 forward of the magazine well 74. A Picatinny rail, alternatively known as the MIL-STD-1913 rail, STANAG 2324 rail, or simply "Tactical Rail" is a bracket used on some weapons to provide a standardized mounting platform. Such a rail comprises a series of ridges, generally with a T-shaped cross-section interspersed with flat "spacing slots." Accessories are mounted either by sliding them on from one end or the other; by means of a clamp 28 such as shown in FIG. 3 such clamps are normally attached to the rail 86 with bolts, thumbscrews or levers; or onto the slots between the raised sections.

Figure 3:
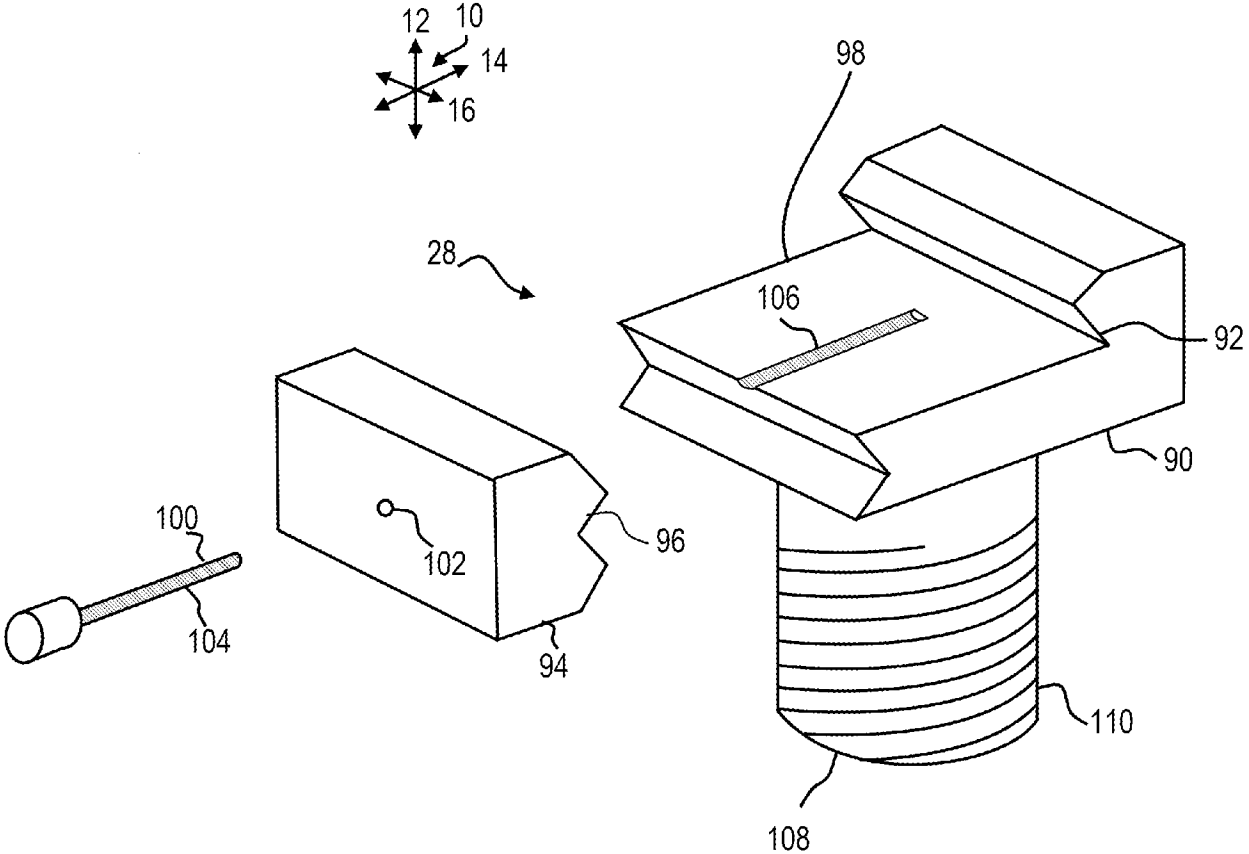
FIG. 3 is an isometric view of one example of a Picatinny rail style clamping device.

The example clamp shown in FIG. 3 comprises a main body 90 having a dovetail 92 at one transverse end. A sliding body 94 is engages the opposing transverse end. The sliding body 94 also has a surface 96 which cooperates with a surface 98 to form a second dovetail. These dovetails cooperate to clamp against the rail 86. Also shown is a thumbscrew 100 which passes through a surface 102 defining a pass-through void and has male threads 104 which engage female threads 106 on the main body as a clamp. The main body of this example also has an extension 108 which attaches to the shaft 30. In another example, the extension 108 is a unitary construction with the shaft 30.

Figure 4:
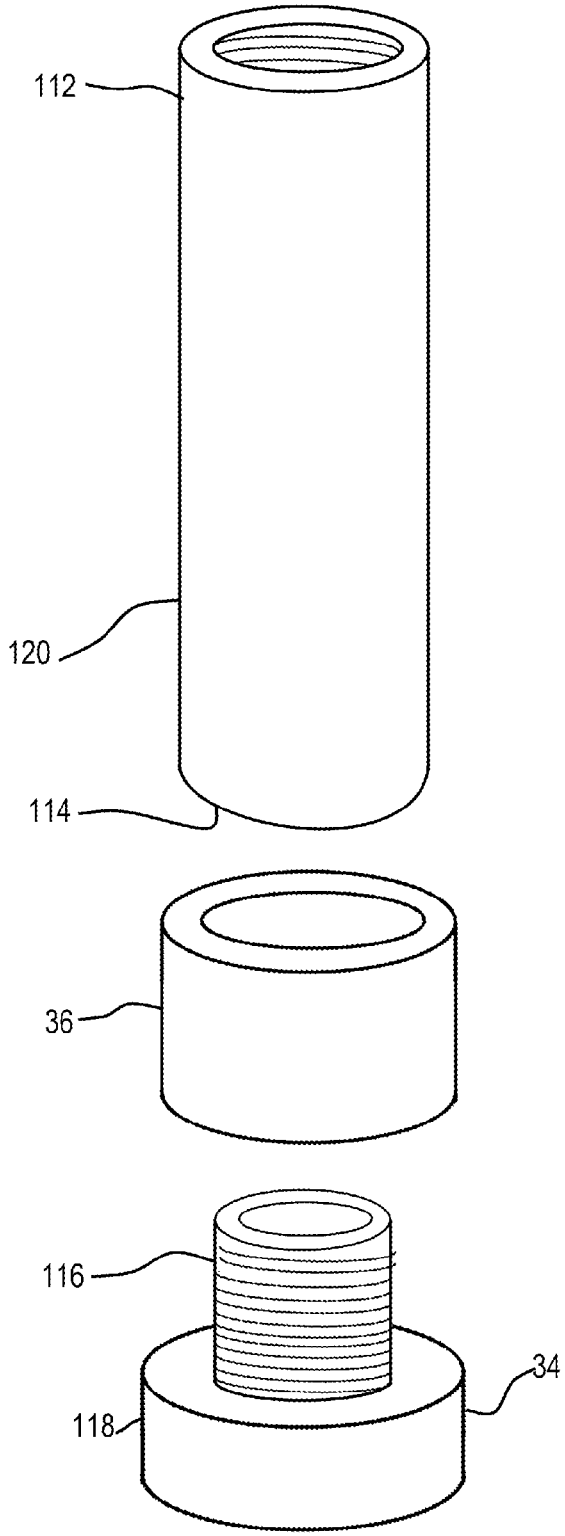
FIG. 4 is an isometric exploded view of several components of one example of the cartridge magazines system.
Figure 5:
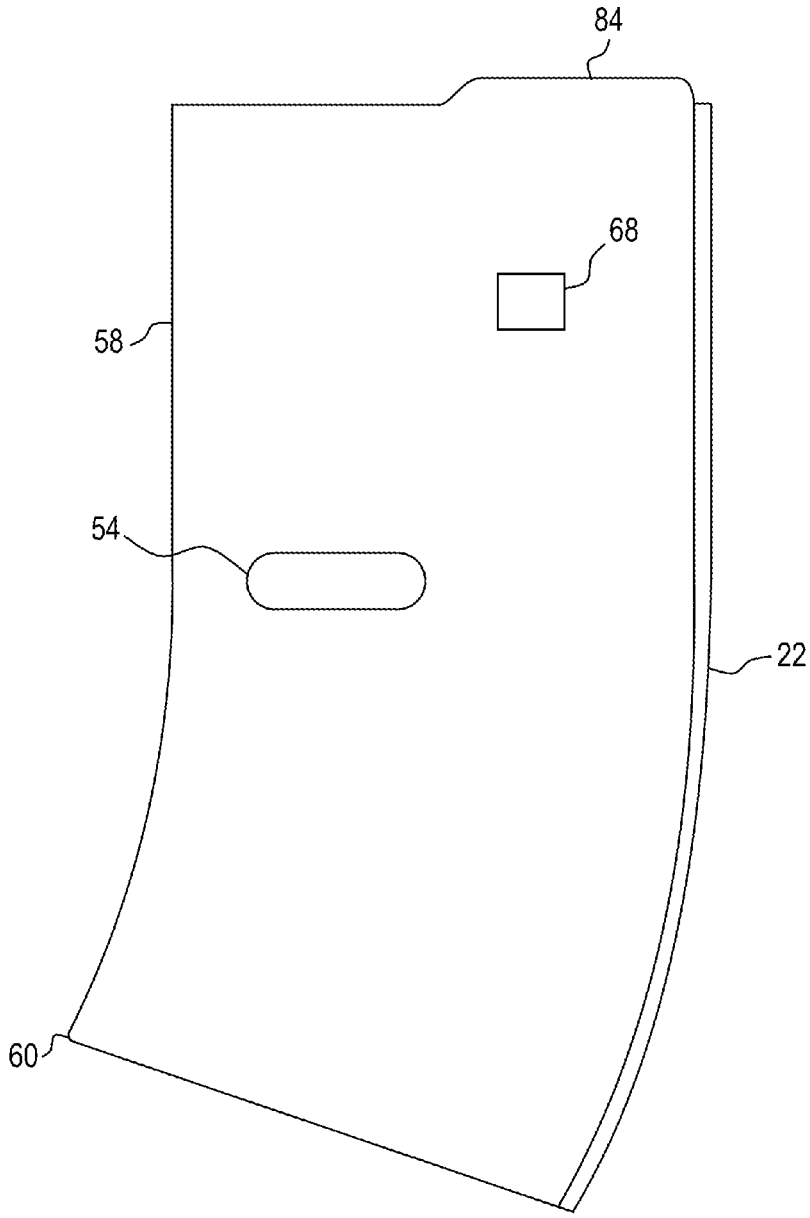
FIG. 5 is a side view of one example of a modified magazine.
Figure 6:
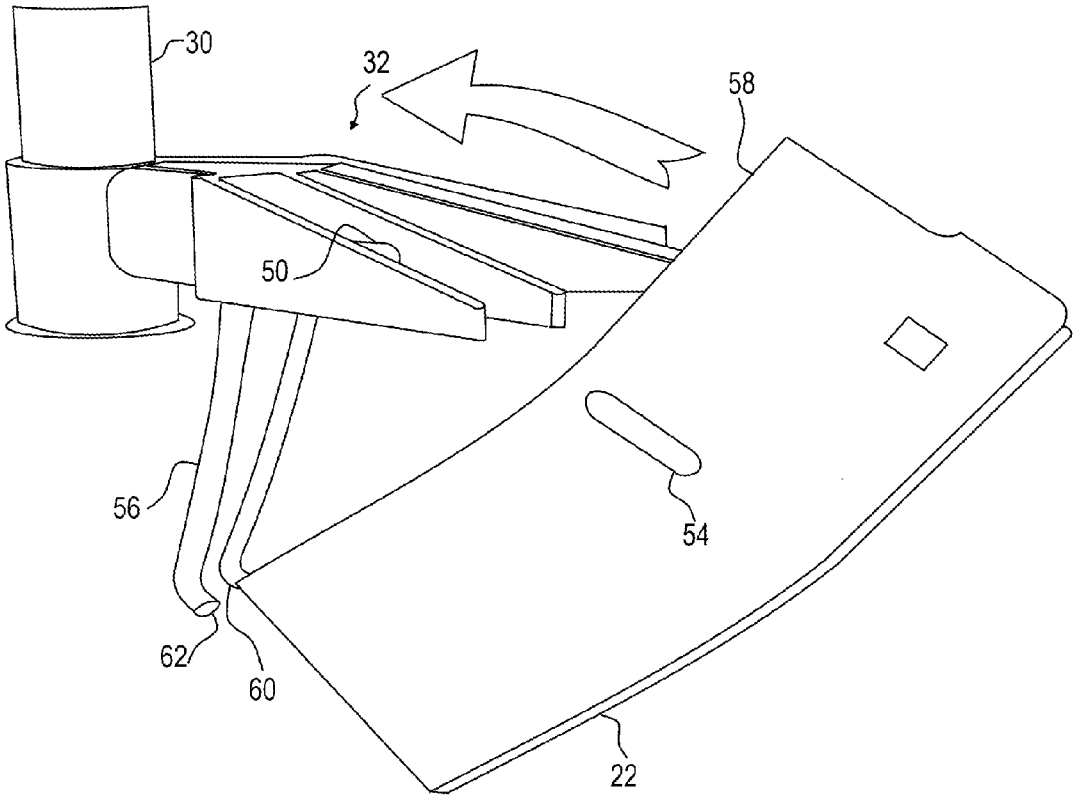
FIG. 6 is an isometric view of one example of a loading step of the cartridge magazine system.

FIG. 4 shows one example of the shaft 30 having female threads 112 which engage the male threads 110 of the clamp body 90 to hold the two components together. In this example, the shaft 30 also comprises female threads 114 which engage male threads 116 on the stop cap 34. Again, the shaft 30 and cap 34 may be a unitary construction. To retain the magazine holder assembly 32 on the shaft 30, the stop cap 34 may have an outer surface 118 which extends radially outward from the outer cylindrical surface 120 of the shaft 30.

As mentioned before, a malleable collar 36 may be placed on the shaft 30 to reduce noise, and keep the slide collar 38 from damaging the stop cap 34.

Figure 8:
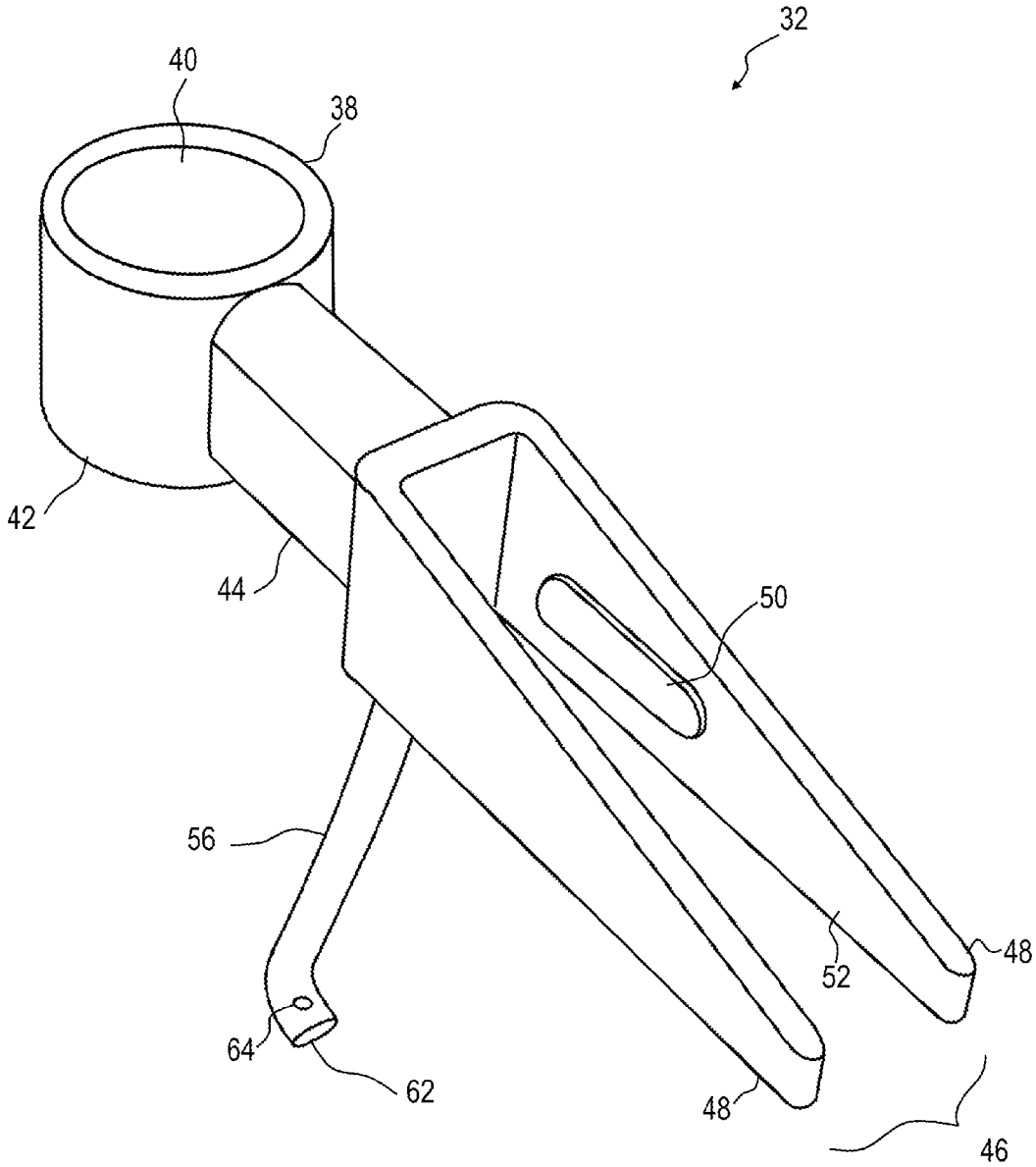
FIG. 8 is an isometric view of a single arm example of a magazine holder component of the cartridge magazine system.
Figure 9:
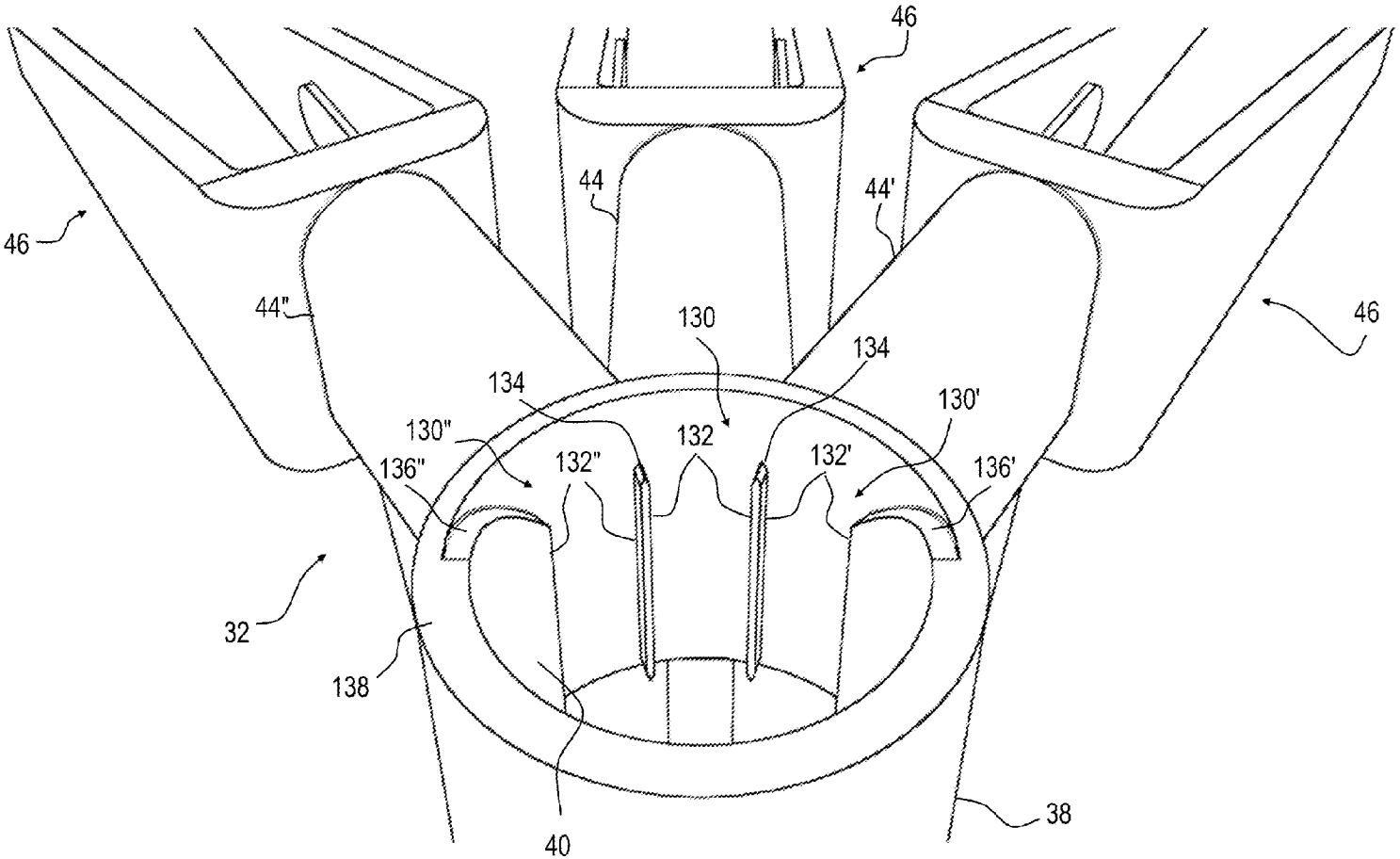
FIG. 9 is a detail isometric view of one example of the sliding collar component with a plurality of guide surfaces thereupon.
Figure 10:
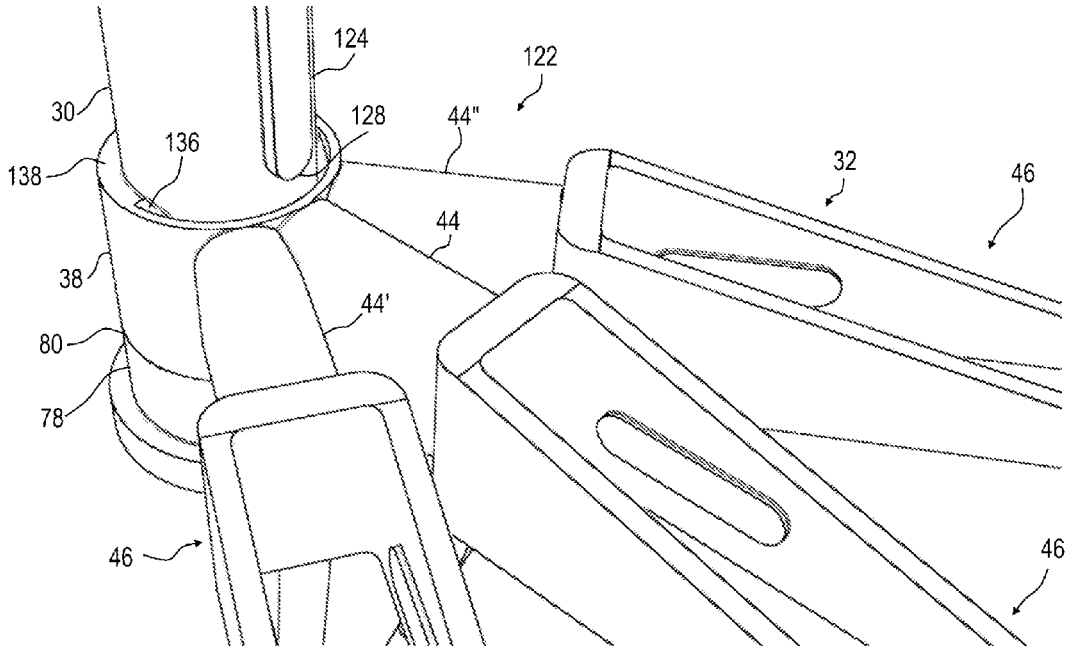
FIG. 10 is a detail isometric view of one example of an indexing system in use on the cartridge magazine system.
Figure 11:
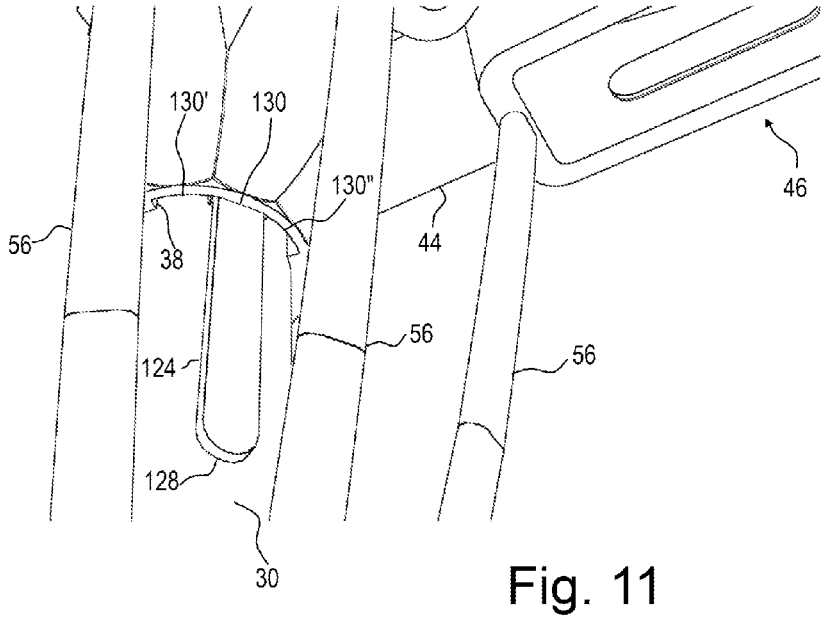
FIG. 11 is another detail isometric view of one example of an indexing system in use on the cartridge magazine system.
Figure 12:
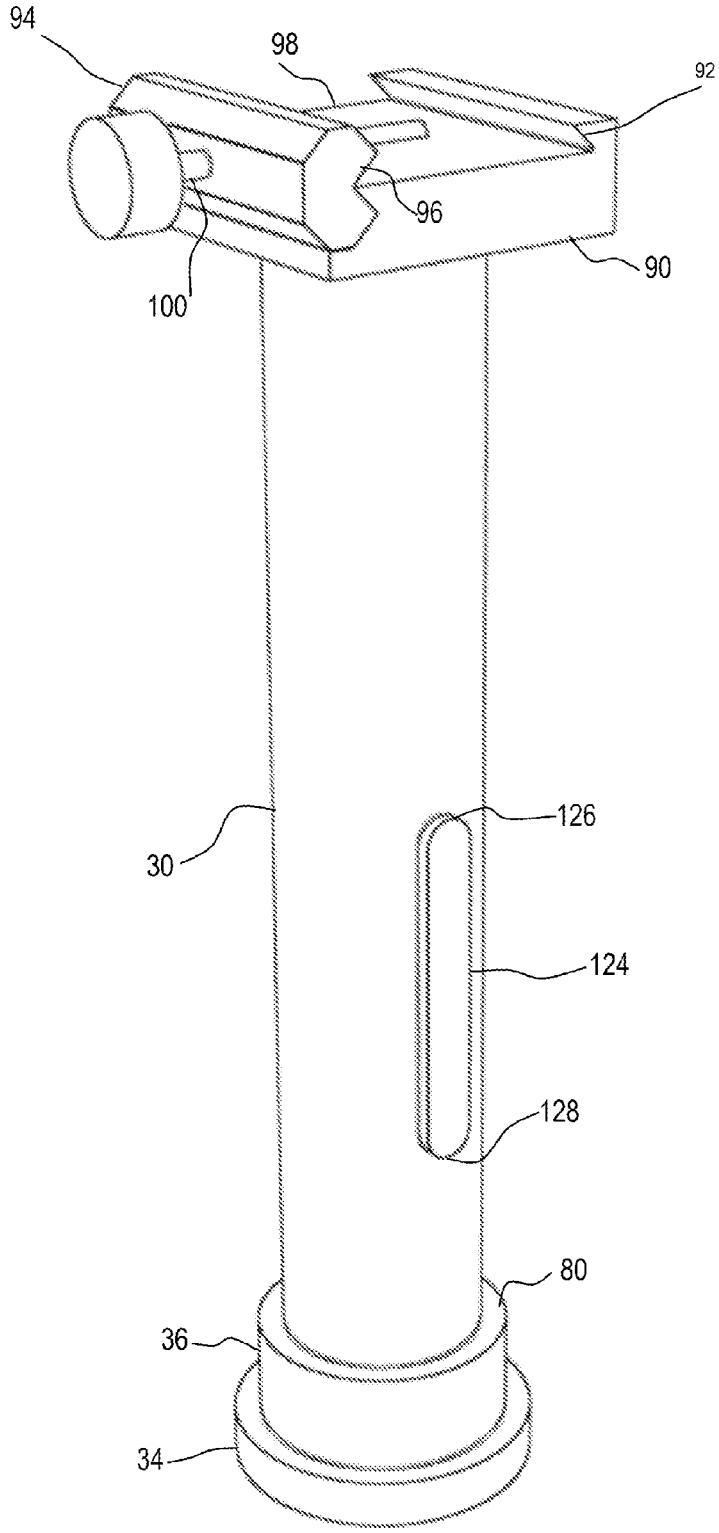
FIG. 12 is an isometric view of one example of the shaft component with a indexing detent thereupon.

In FIG. 8 a single magazine holder assembly is shown which may be combined with the apparatus disclosed above. This example may also be used in combination with apparatus of similar structure so that movement of the magazines may be accomplished independently.

Looking to FIGS. 9-12 is shown one example of an indexing system 122. This example of an indexing system utilizes an indexing detent 124 on the shaft which cooperates with indexing guides 130. The indexing detent 124 having a lower edge 128 which in this example may be rounded to aid in alignment of the detent 124 with an indexing guide 130 most easily seen in FIG. 9. Also, the upper edge 126 may be rounded or tapered in a similar manner.

The indexing guides 130, 130', and 130" coordinate with arms 44, 44', and 44" respectively to aid the shooter in aligning a modified magazine 22 with the magazine well 74. In the example shown in FIG. 10, the top edge 138 of the collar 38 is in a resting position below the bottom edge 128 of the detent 124 such that the magazine holder assembly 32 can freely rotate to align different indexing guides 130 with the detent 124. This arrangement also allows the magazine holder assembly 32 to rotate out of the way for manual/non assisted loading of the magazine well 74. Alternatively, the top edge 138 of the collar 38 may extend above the bottom edge 128, while the top edge 134 of alignment surfaces 132 may be slightly below the lower edge 128 so that the magazine holder assembly 32 is limited in its rotation by directing surfaces 136. In another example, the top edge 134 of the guide surfaces may be just slightly above the bottom edge 128 of the detent 124. Thus, rotation of the magazine holder assembly 32 results in the contact between the surfaces, and compression of the malleable collar 36 allows for indexing of the guide surfaces. Each example aids the shooter in alignment of the cartridge magazine 22 with the magazine well 74 prior to engagement of these two components allowing for a faster and easier re-load of the magazine well 74.

The tapered lower edge 128 may assist in alignment of the indexing guides 130 with the indexing detent 124. The magazine holder assembly 32 is raised and the indexing detent 124 engages an indexing guide 130 to align the selected cartridge magazine 22 with the magazine well 74 prior to contact between the cartridge magazine 22 and the magazine well 74.

To further aid in alignment, the central indexing guide(s) 130 may comprise guide surfaces 132 while circumferentially outer guides 130' and 130" may comprise guide surfaces 132' and 132" respectively. In the example shown, guide surfaces 132' and 132" cooperate with directing surfaces 136' and 136" to aid the shooter in aligning the detent 124 into the appropriate indexing guide.

While the present invention is illustrated by description of several embodiments and while the illustrative embodiments are described in detail, it is not the intention of the applicants to restrict or in any way limit the scope of the appended claims to such detail. For example, holder assemblies capable of holding one or three magazines are shown, and holder assemblies capable of holding 2, 4, 5, or more magazines are conceived. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A cartridge magazine system to hold a plurality of cartridge magazines adjacent to a magazine well of a weapon, the system comprising:

a. a rigid cylindrical shaft having a center axis aligned with an insert axis of the magazine well, b. a cartridge magazine holder assembly comprising:
   i. a collar in contact with the shaft so as to freely reposition along the shaft a distance greater than an insert distance of the magazine well;
   ii. the collar rotatable about the shaft;
   iii. at least one fork extending radially from the collar;
   iv. each fork having an engagement surface for retention of a cartridge magazine in position to be inserted into the magazine well, and removed therefrom without removing the cartridge magazine from the fork; and
c. a stop cap at a lower end of the shaft to maintain position of the cartridge magazine holder assembly upon the shaft.

2. The cartridge magazine system as recited in claim 1 wherein:
a. the engagement surface on the fork comprises a detent;
b. the cartridge magazine comprises an indent on a transverse side thereof, and;
c. the detent of the fork engages the indent of the cartridge magazine to retain the magazine on the fork.

3. The cartridge magazine system as recited in claim 2 wherein:
a. each engagement surface on the fork comprises a detent;
b. the cartridge magazine comprises an indent on each transverse side thereof, and;
c. each detent of the fork engages one of the detents of the magazine cartridge to retain the magazine on the fork.

4. The cartridge magazine system as recited in claim 1 further comprising:
a. a guide bar extending from the cartridge magazine holder assembly; and
b. the guide bar having a rearward curved bottom end which engages and retains a forward bottom edge of the cartridge magazine to further hold the cartridge magazine in the fork.

5. The cartridge magazine system as recited in claim 4 wherein the bottom end of the guide bar comprises a visual marker.

6. The cartridge magazine system as recited in claim 5 wherein the visual marker is luminescent.

7. The cartridge magazine system as recited in claim 1 further comprising:
a. a clamp fixedly attached to the rigid cylindrical shaft; and
b. the clamp removably attached to a structure of the weapon.

8. The cartridge magazine system as recited in claim 7 wherein the structure to which the claim is attached is a Picatinny style rail.

9. The cartridge magazine system as recited in claim 1 further comprising a malleable collar mounted to the shaft.

10. The cartridge magazine system as recited in claim 1 further comprising:
a. an indexing system; and
b. wherein the indexing system utilizes at least one indexing guide for each fork so as to mechanically align a selected cartridge magazine held in a selected fork with the magazine well.

11. The cartridge magazine system as recited in claim 10 wherein the indexing system comprises an indexing detent which engages directing surfaces of the indexing guides to mechanically align the selected fork with the magazine well.

12. The cartridge magazine system as recited in claim 11 wherein the detent extends radially from the rigid cylindrical shaft.

13. The cartridge magazine system as recited in claim 11 wherein the detent has a lower edge which is above the upper edge of the collar so as to allow free rotation of the collar when the collar is positioned on the shaft below the lower edge of the detent.

14. A method for reloading a weapon having a magazine well, the method comprising the steps of:
a. providing a cartridge magazine system comprising:
   i. a rigid cylindrical shaft having a center axis aligned with an insert axis of the magazine well,
   ii. a cartridge magazine holder assembly comprising:
      a collar in contact with the shaft so as to freely reposition along the shaft a distance greater than an insert distance of the magazine well;
      the collar rotatable about the shaft;
      at least one fork extending radially from the collar;
      each fork having an engagement surface for retention of a cartridge magazine in position to be inserted into the magazine well, and removed therefrom without removing the cartridge magazine from the fork; and
   iii. a stop cap at a lower end of the shaft to maintain position of the cartridge magazine holder assembly upon the shaft;
b. attaching a first loaded cartridge magazine into a first fork of the cartridge magazine holder;
c. attaching a second loaded cartridge magazine into the cartridge magazine holder; and
d. repositioning the cartridge magazine holder along the shaft so as to insert the first loaded cartridge into the magazine well.

* * * * *